US010144123B1

(12) United States Patent
Shaw

(10) Patent No.: US 10,144,123 B1
(45) Date of Patent: Dec. 4, 2018

(54) AIR LINE PLUG CONNECTOR DEVICE

(71) Applicant: Linda J Freiheit, Lapeer, MI (US)

(72) Inventor: Byron Shaw, Lapeer, MI (US)

( * ) Notice: Subject to any disclaimer, the term of this patent is extended or adjusted under 35 U.S.C. 154(b) by 4 days.

(21) Appl. No.: 15/665,232

(22) Filed: Jul. 31, 2017

Related U.S. Application Data

(60) Provisional application No. 62/369,605, filed on Aug. 1, 2016.

(51) Int. Cl.
*B25H 3/00* (2006.01)
*B25H 5/00* (2006.01)
*B25H 1/08* (2006.01)

(52) U.S. Cl.
CPC ..... *B25H 3/006* (2013.01); *B25H 1/08* (2013.01); *B25H 3/003* (2013.01); *B25H 5/00* (2013.01)

(58) Field of Classification Search
CPC . B25H 5/00; B25H 1/08; B25H 3/006; B25H 3/003
USPC ..... 248/510, 912, 315, 214, 229.17, 229.26, 248/230.8, 230.9; 224/217, 219, 267; D8/395, 396
See application file for complete search history.

(56) References Cited

U.S. PATENT DOCUMENTS 261,385 A * 7/1882 Roelofs ..... F21V 21/02 362/457
845,739 A * 3/1907 Alson ..... A47F 7/06 211/33
1,286,610 A * 12/1918 Harriman ..... B25G 1/107 131/258
1,816,301 A * 7/1931 Sundell ..... F16B 2/245 24/339
2,696,963 A * 12/1954 Shepherd ..... A61M 5/1415 24/339
2,824,651 A * 2/1958 Davis ..... A61C 3/04 211/69
2,884,478 A * 4/1959 Becker ..... H01R 4/186 174/94 R
3,212,146 A * 10/1965 Morgan ..... B43K 23/001 24/10 R
3,778,537 A * 12/1973 Miller ..... H01Q 1/1228 174/138 R
3,851,847 A * 12/1974 Hinkley ..... B62J 11/00 248/230.8
4,114,241 A * 9/1978 Bisping ..... F16L 3/13 403/188
4,406,042 A * 9/1983 McPhee ..... A61M 5/1418 24/129 A
D295,725 S * 5/1988 Shioda ..... D8/380
D298,739 S * 11/1988 Richards, Jr. ..... D22/110
4,787,591 A * 11/1988 Villacorta ..... B01L 9/50 24/339
4,844,308 A * 7/1989 Porteous ..... A61C 19/006 224/217
D309,255 S * 7/1990 Karow, Jr. ..... D22/110
(Continued)

*Primary Examiner* — Michael Safavi
(74) *Attorney, Agent, or Firm* — Ronald R. Kilponen

(57) ABSTRACT

An air line connector is shown and disclosed that affixes to the distal end of an air hose. The connector has a hose opening that slips over the air line. A tool opening is configured to hold and retain air tools. This allows the user to remove an air tool from the air hose and insert it into the air line connector for retention when a second tool can now be installed on the air hose. A second embodiment provides for the storage of two tools in the air line connector.

2 Claims, 4 Drawing Sheets

(56) References Cited

U.S. PATENT DOCUMENTS 5,036,164 A * 7/1991 Schrader ..... H01R 4/186 174/94 R
5,079,802 A * 1/1992 Blase ..... A47L 9/248 24/16 PB
5,288,047 A * 2/1994 Pan ..... F16L 3/237 248/229.26
5,290,261 A * 3/1994 Smith, Jr. ..... A61M 5/3129 433/49
D353,986 S * 1/1995 Maglica ..... D12/114
D359,817 S * 6/1995 Leveika ..... D26/138
D363,017 S * 10/1995 Noble ..... D8/395
D363,211 S * 10/1995 Noble ..... D8/371
5,542,209 A * 8/1996 Sheu ..... A01G 9/128 24/339
5,580,020 A * 12/1996 Catchings ..... B63B 29/04 248/311.2
5,597,148 A * 1/1997 Gospodarich ..... A47C 7/68 248/230.5
5,605,312 A * 2/1997 Elder ..... A47C 7/68 248/229.26
5,632,552 A * 5/1997 Wang ..... F21V 21/08 362/396
5,642,557 A * 7/1997 Clews ..... E04B 2/7442 24/298
5,704,526 A * 1/1998 Kuo ..... B62H 5/00 224/425
5,806,822 A * 9/1998 Schulz ..... A61B 90/50 211/70.6
5,957,155 A * 9/1999 Lovejoy ..... B05B 15/00 137/356
6,112,897 A * 9/2000 Hu ..... B25H 3/003 206/372
6,141,838 A * 11/2000 Cooper ..... A45D 40/00 24/329
6,158,095 A * 12/2000 Lassiter ..... F16L 3/237 24/129 R
6,186,383 B1 * 2/2001 Kobdish ..... B62J 6/00 224/420
D444,603 S * 7/2001 Murphy ..... D32/31
6,298,525 B1 * 10/2001 Margo ..... F16L 3/237 24/336
6,523,231 B1 * 2/2003 Lassiter ..... F16L 3/237 24/129 R
6,651,946 B1 * 11/2003 Thornton ..... A61G 5/10 248/230.7
6,908,216 B2 * 6/2005 Love ..... A01K 75/02 362/191
6,932,223 B1 * 8/2005 Lee ..... B25H 3/04 206/349
6,942,532 B2 * 9/2005 Snyder ..... B63B 35/7933 114/382
D515,411 S * 2/2006 Kearl ..... D8/395
D534,065 S * 12/2006 Andre ..... D8/395
D537,331 S * 2/2007 Hill ..... D8/395
D570,203 S * 6/2008 Shiomoto ..... 24/297
7,886,406 B2 * 2/2011 Chang ..... E05D 5/08 16/252
7,959,122 B1 * 6/2011 Clack-Hopkins ... A61M 5/1417 211/107
D660,690 S * 5/2012 Mixides ..... D8/396
8,522,394 B2 * 9/2013 Lee ..... A47L 9/0036 15/323
8,820,690 B2 * 9/2014 Weber ..... A42B 3/044 248/229.15
2004/0206649 A1 * 10/2004 Chen ..... B25F 5/029 206/379
2006/0101955 A1 * 5/2006 Chang ..... B25B 15/008 81/490
2010/0012539 A1 * 1/2010 Wang ..... B25H 3/003 206/379
2010/0133305 A1 * 6/2010 Stewart ..... B25H 3/006 224/197
2014/0263910 A1 * 9/2014 Featherston ..... A44C 5/0046 248/315
2014/0299640 A1 * 10/2014 Escherich ..... B25H 3/003 224/183

* cited by examiner

AIR LINE PLUG CONNECTOR DEVICE

CROSS REFERENCE TO RELATED APPLICATIONS

This utility application claims priority from Provisional Application for patent application number 62369605 titled Air Line Plug Connector Device filed Aug. 1, 2016.

FIELD

The present version of this device relates generally to the field of devices that are used to hold tools or fittings in a convenient location for the user.

BACKGROUND

This device relates to the convenience of tool or fitting storage, and more particularly to a device that can be affixed to an air hose to hold tools or other fittings such that the tools or other fittings can be swapped out quickly and easily and also provide storage for the tools or fittings that are not being used.

Many persons use air tools. Air tools are used for many different purposes. Generally speaking, air tools utilize an air compressor that can either be electrically powered or gasoline powered. The compressor uses ambient air and compresses the air into a tank generally affixed to the compressor. A hose and valve are attached to the compressed air tank to get the compressed air via an air hose, to the location where the user requires the compressed air. The other end or distal end of the hose has a fitting to which can be attached any number of air tools. The air tools have a common fitting that allows the user to swap out various tools from the air hose. The user can then use the air tools to perform the work or project.

Many times when the user requires a different tool, they must then swap out the original tool and replace with the second tool. They must place the original tool down or put it into a pocket or on the ground or work bench etc. This can lead to the original tool being misplaced or even lost. This can greatly effect a workers productivity and add to the project frustration if tools cannot be found. It can be expensive if new tools need to be purchased to replace those misplaced.

For the foregoing reasons, there is a need for an air line plug connector device. If the user were to have a convenient place to house or store one or more tools while using the second tool this would be a benefit. This would decrease the likelihood of losing tools, misplacing them and adding time, expense and frustration to a project. If the air line plug connector device had an interface that was common to the tools themselves, this would be a benefit. It would also be beneficial of this air line plug connector was capable of holding two tools at the same time. It would be beneficial if the device would attached to a standard size air hose.

SUMMARY

In view of the foregoing disadvantages inherent in the area of tool storage when using air tools, there is a great need for an air line plug connector device.

A first objective is to provide a device that is convenient to store tools when using an air hose.

Another objective is to provide a device that can decrease the likelihood of losing tools when using an air hose.

It is yet another objective to provide a device that would fit a large number of typical air tools.

It is a still further objective to provide a device that makes it easy to fix the tools for storage.

Another objective is to provide a device that can hold two tools.

Another objective is to provide a device that attaches to a standard sized air hose.

These together with other objectives of this device, along with various features of novelty which characterize this device, are pointed out with particularity in the claims annexed hereto and forming a part of this disclosure. For a better understanding of this device, its operating advantages and the specific objectives attained by its uses, reference should be had to the accompanying drawings and descriptive matter in which there is illustrated a preferred embodiment.

DETAILED DESCRIPTION

Figure 1:
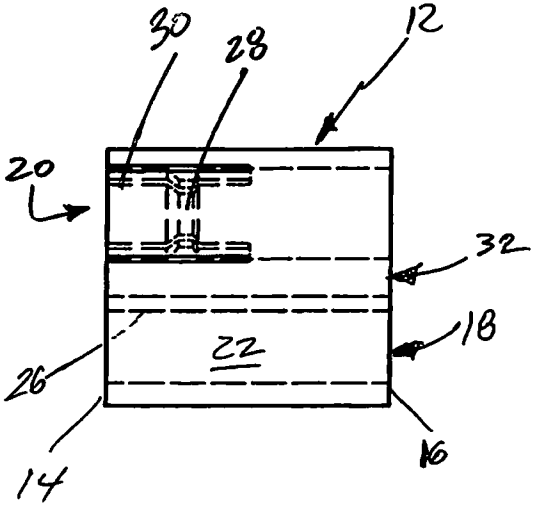
FIG. 1 shows a side view of one embodiment of the air line plug connector device.

Referring to the drawings in detail wherein like elements are indicated by like numerals, there is shown in FIG. 1 a side view of one embodiment of the air line plug connector device 12. The device 12 has a first end 14 and a second end 16. There is a hose opening 18 which is generally an open cylinder running from the first end 14 to the second end 16. The hose opening 18 has a first side 22 and second side 24, between the first and second sides 22, 24 is located at least one ridge 26 that runs from the first end 14 to the second end 16.

The intersection of the first and second sides 22, 24 forms a mid section 32 which is connected to a tool opening 20. Tool opening 20, like the hose opening 18, runs from the first end 14 to the second end 16. The tool opening 20 is generally a hollow cylinder. In this embodiment, near the first end 14 is located a retainer 28.

Retainer 28 is a ring or ridge raised from the interior of the tool opening 20 towards the center of the tool opening 20, FIG. 1. A plurality of slots 30 are cut part way through the exterior length of tool opening 20. This embodiment shows four slots 30 all approximately 90 degrees from one another and cut through the retainer 28, best seen FIGS. 1, 2, 4. The slots 30 extend a fixed distance from the first end 14. The slots 30 provide some flexibility or springy-ness to the tool opening 20 for the insertion of a tool.

Figure 2:
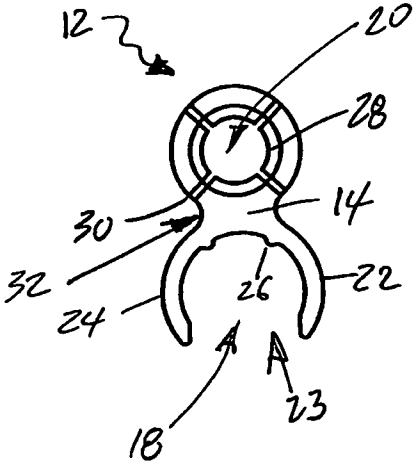
FIG. 2 shows an end view of one embodiment of the air line plug connector device of FIG. 1.

FIG. 2 shows a view of the connector 12 from the first end 14. One can see the ridge 26 in the hose opening 18, this embodiment shows two ridges 26. One can see the slots 30 and retainer 28 in the tool opening 20. The opening 23 between the first side 22 and second side 24 is clearly seen also. The opening 23 is meant to be slipped over an air line running from a compressor (not shown). As can be appreciated, the opening 23 would slip over the air line, the ridges 26 would provide additional strength to the hose opening 18 and also help retain the relative position of the connector 12 on the air hose thereby helping to prevent sliding of the connector 12 on the air hose (not shown).

When the connector 12 hose opening 18 is attached to the air hose, tools can be removed from the distal end of the air hose and the fittings on the tool end can be inserted into the tool opening 20 from the first end 14. When the tool end is inserted it opens the walls of the tool opening 18 as it passes by the retainer 28. As the tool end passes the retainer 28 the walls compress back to the approximately original position and the tool is then retained in the tool opening 20.

The removed tool can then be retained in the connector 12 which is affixed to the air hose. The removed tool is less likely to be misplaced or lost and the user can swap out various tools quickly and easily to complete their project in a timely manner.

Figure 3:
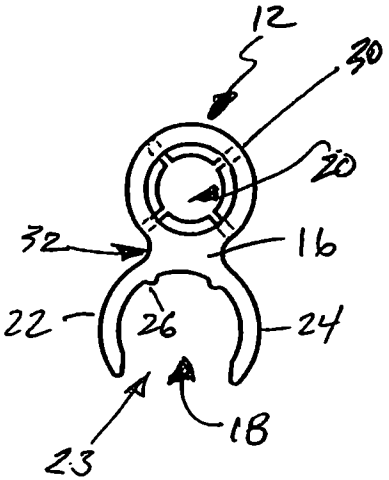
FIG. 3 shows an opposite end view of one embodiment of the air line plug connector device of FIG. 1.

FIG. 3 shows a second end 16 view of the connector 12.

Figure 5:
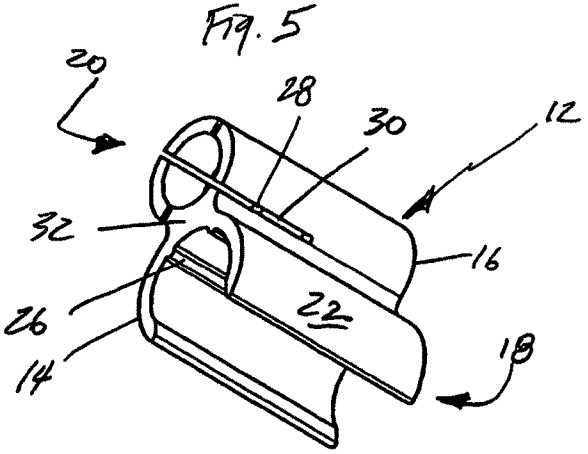
FIG. 5 shows a first end bottom perspective view of the air line plug connector device of FIG. 1.
Figure 4:
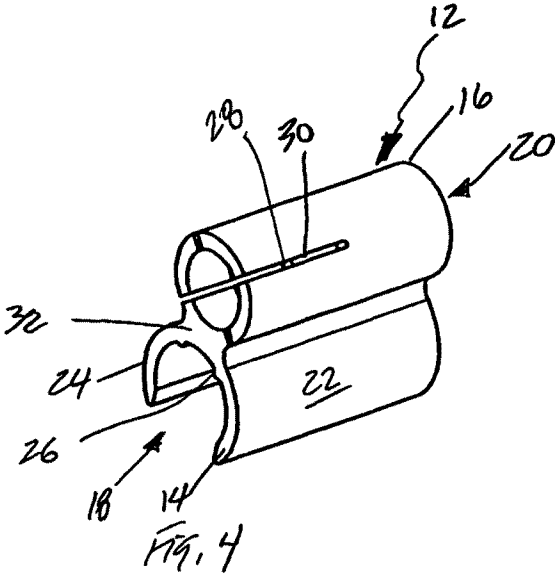
FIG. 4 shows a first end top perspective view of the air line plug connector device of FIG. 1.

FIG. 4 shows a first end 14 top perspective view of the air line plug connector 12 device. FIG. 5 shows a first end 14 bottom perspective view of the air line plug connector 12 device.

Figure 8:
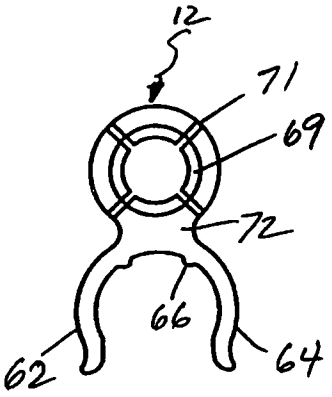
FIG. 8 shows an opposite end view of one embodiment of the air line plug connector device of FIG. 6.
Figure 6:
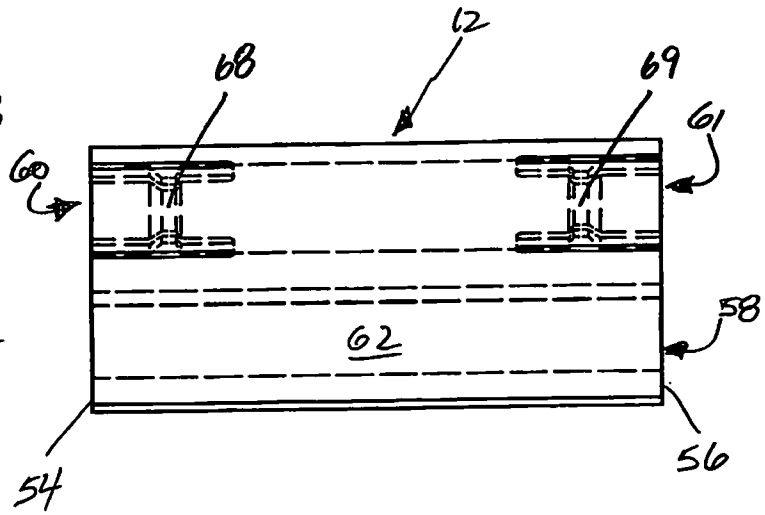
FIG. 6 shows a side view of another embodiment of the air line plug connector device.
Figure 7:
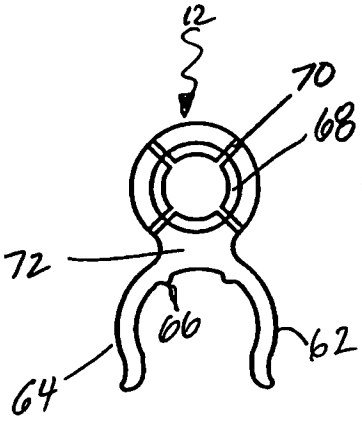
FIG. 7 shows an end view of one embodiment of the air line plug connector device of FIG. 6.

FIG. 6 shows another embodiment of the air line plug connector 12. This embodiment shows a first retainer 68 and second retainer 69 where this embodiment can thereby house two air tool attachments at the same time. The first side 62 is longer than the previous embodiment to allow room for both of the retainers 68, 69 and connection of the tools. The connector 12 has a first end 54 and a second end 56. Hose opening 58 has a first side 62 and second side 64, FIGS. 7,8 and at least one ridge 66 running form the first end 54 to the second end 56. A mid section 72 connects the hose opening 58 to the tool opening 60. The tool opening 60 has the first retainer 68 located near the first end 54 and a second retainer 69 located near the second end 56. A plurality of slots 70 extend from the first end 54 towards and through the first retainer 68, FIGS. 7,8,9. Likewise, a plurality of slots 71 extend from the second end 56 and through the second retainer 69, see FIGS. 7,8,9.

When the connector 12 hose opening 58 is attached to the air hose (not shown), tools can be removed from the distal end of the air hose and the fittings on the tool end can be inserted into the first tool opening 60 from the first end 54. When the tool end is inserted it opens the walls of first tool opening 60 as it passes by first retainer 68. As the tool end passes first retainer 68 the walls compress to approximately their original position and the tool is then retained in the tool opening 60.

Likewise a second tool end can be inserted into the second tool opening 61 from the second end 56. When the tool end is inserted it opens the walls of the second tool opening 61 as it passes by second retainer 69. As the tool end passes second retainer 69 the walls compress to approximately their original position, the tool is then retained in the second tool opening 61.

Figure 9:
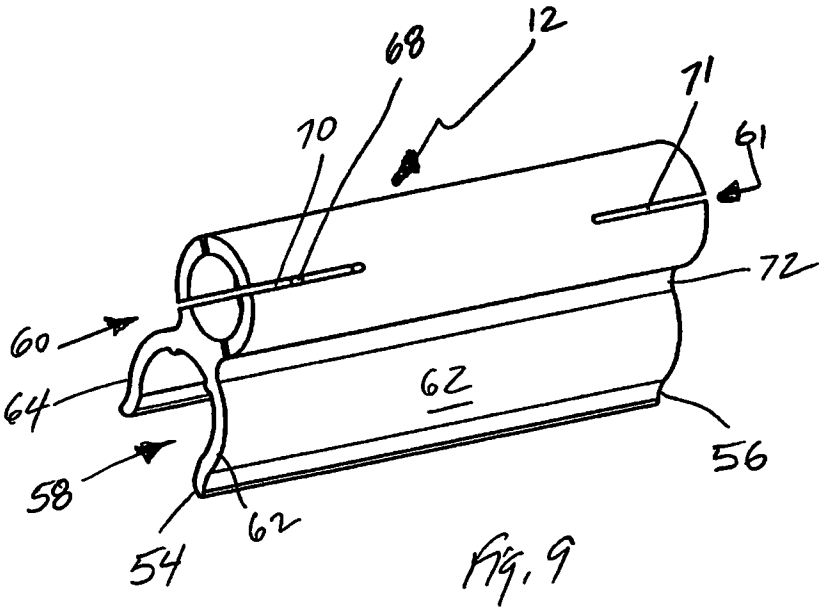
FIG. 9 shows a first end top perspective view of the air line connector device of FIG. 6.

FIG. 9 shows a first end 54 top perspective view of the connector 12 capable of holding two tools.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A device for attaching air line tools to an air line, the device comprising:

a connector, the connector having a first end and a second end;

a hose opening running from the first end to the second end, the hose opening having an opening for receiving the air line and an inner surface, at least one ridge extending from the first end to the second end of the inner surface of the hose opening;

a mid section attached to the hose opening running from the first end to the second end;

a tool opening attached to the mid section and running from the first end to the second end, the tool opening having an outer surface and an inner surface, a retainer located within the tool opening, the retainer located a fixed distance from the first end; and a plurality of slots in the tool opening surfaces parallel to the tool opening and extending a fixed distance from the first end.

2. A device for attaching air line tools to an air line, the device comprising:

a connector, the connector having a first end and a second end;

a hose opening running from the first end to the second end, the hose opening having an opening for receiving the air line and an inner surface, at least one ridge extending from the first end to the second end of the inner surface of the hose opening;

a mid section attached to the hose opening running from the first end to the second end;

a tool opening attached to the mid section and running from the first end to the second end, the tool opening having an outer surface and an inner surface, a retainer located within the tool opening, the retainer located a fixed distance from the first end, a second retainer, the second retainer located a fixed distance from the second end; and a plurality of slots in the tool opening surfaces parallel to the tool opening and extending a fixed distance from the first end and second end.

* * * * *